US006094780A

United States Patent [19]

McGlothlin et al.

[11] Patent Number: 6,094,780

[45] Date of Patent: Aug. 1, 2000

[54] ERGONOMIC HANDLE FOR TERMINAL INSERTION TOOL

[75] Inventors: James D. McGlothlin, Cincinnati; Ova E. Johnston, Franklin; Cheryl Fairfield Estill, Cincinnati, all of Ohio

[73] Assignee: The United States of America as represented by the Department of Health and Human Services, Washington, D.C.

[21] Appl. No.: 09/011,248

[22] PCT Filed: Jul. 25, 1996

[86] PCT No.: PCT/US96/12339

§ 371 Date: Jan. 27, 1998

§ 102(e) Date: Jan. 27, 1998

[87] PCT Pub. No.: WO97/04927

PCT Pub. Date: Feb. 13, 1997

Related U.S. Application Data

[60] Provisional application No. 60/001,596, Jul. 27, 1995.

[51] Int. Cl.[7] ..... B25B 23/16; B25G 1/10

[52] U.S. Cl. ..... 16/430; 16/422; 29/750; 81/489; 81/177.1

[58] Field of Search ..... 16/110.1, 430, 16/436, DIG. 12; 81/177.1, 489; 30/164.5, 164.8, 164.9, 172, 169, 526, 534; 29/750, 751, 861

[56] References Cited

U.S. PATENT DOCUMENTS

| | | | |
|---|---|---|---|
| 525,154 | 8/1894 | Mushette . | |
| 751,848 | 2/1904 | Goldsmith . | |
| 2,674,286 | 4/1954 | Carson | 81/177.1 |
| 3,080,900 | 3/1963 | Rosenberg | 81/177.1 |
| 4,038,719 | 8/1977 | Bennett | 16/110.1 |
| 4,380,093 | 4/1983 | Morgan . | |
| 4,380,118 | 4/1983 | Driver et al. . | |
| 4,408,391 | 10/1983 | Pohl | 29/751 |
| 4,488,460 | 12/1984 | Ballone . | |
| 4,631,853 | 12/1986 | Brackett et al. . | |
| 4,656,725 | 4/1987 | Knickerbocker | 29/751 |
| 4,663,838 | 5/1987 | Dewey et al. . | |
| 4,759,122 | 7/1988 | Weintraub . | |
| 4,885,818 | 12/1989 | Arterbury . | |
| 4,899,415 | 2/1990 | Wheeler | 81/177.1 |
| 4,964,192 | 10/1990 | Marui | 16/430 |
| 5,025,560 | 6/1991 | Townsend . | |
| 5,027,512 | 7/1991 | Andrews . | |
| 5,365,811 | 11/1994 | Chi . | |
| 5,440,784 | 8/1995 | Hull et al. | 16/430 |
| 5,692,265 | 12/1997 | Dalury | 16/DIG. 12 |
| 5,829,099 | 11/1998 | Kopelman et al. | 16/430 |

FOREIGN PATENT DOCUMENTS

| | | |
|---|---|---|
| 23 44 987 | 3/1975 | Germany . |
| WO 91/06405 | 5/1991 | WIPO . |
| WO 94/03052 | 2/1994 | WIPO . |

*Primary Examiner*—Anthony Knight
*Assistant Examiner*—Donald M. Gurley
*Attorney, Agent, or Firm*—Jones & Askew, LLP

[57] ABSTRACT

An ergonomic tool handle (21) which is useful for a terminal insertion hand tool, gardening hand tools, knives, box cutters, screwdrivers and other pushing or pulling type hand tools. The tool handle (21) of the present invention is contoured to promote neutral posture between the hand and wrist as well as complementing the shape of the closed hand to distribute longitudinal tool forces evenly throughout the hand and arm of the user. The tool handle (21) accomplishes this neutral posture and contoured fit by featuring a hump-like crown (28) which fits snugly into the pocket of the palm, a relatively flat underside (29) around which the user's finger tips (55–57) are wrapped and two sides (51, 52) with convex regions (30, 31) in diagonally offset relation. By moving one's hand up or down the tool handle (21), one size of tool handle (21) can ergonomically fit approximately 95% of male and female hand sizes.

7 Claims, 4 Drawing Sheets

ERGONOMIC HANDLE FOR TERMINAL INSERTION TOOL

This Appln is a International 371 of PCT/US96/12339 filed Jul. 25, 1996, this file is also claiming the benefit of U.S. Provisional No. 60/001,596 filed Jul. 27, 1995.

TECHNICAL FIELD OF THE INVENTION

The present invention relates to an improved tool handle which, in one embodiment, is particularly useful for a terminal insertion tool. Other uses of this improved tool handle include gardening hand tools, knives, box cutters, screwdrivers and other pushing or pulling type hand tools.

BACKGROUND OF THE INVENTION

Existing tool handles for manual household and industrial tools come in a variety of shapes and sizes. Often such handles are in the shapes of cylinders or polygonal prisms. When using such tools, the end of the cylinder or polygonal prism is usually pressed into the pocket in the palm of the hand. This pressing of the tool handle into the palm of the hand is illustrated in FIG. 1 for a prior art terminal insertion hand tool of the type often used in industry for manufacturing appliances and other electronic products. These terminal insertion hand tools are used to connect wires ends or "spades" into the sockets or "terminals" in the body of the appliance or other electronic product.

As the end of a cylindrical or polygonal prism tool handle is pressed into the palm of the hand, it will often cut off blood flow through the atrial arch of the palm, pinch the median, radial and ulnar nerves and compress the tendons which close the hand. This cutting off of blood flow and nerve pinching can create a numbness and tingling sensation in the fingers of the hand. If such a prior art tool is used repeatedly, such as in an appliance manufacturing operation, the continued assault on the blood vessels and nerves in the palm of the hand can lead to several adverse medical conditions, including carpal tunnel syndrome.

A number of efforts have been made to try to alleviate the causes of these adverse medical conditions by redesigning the tool handle. For example, tool handles have been made in a bulb-like shape to avoid sharp cylinder or polygonal prism edges pressing into the palm of the hand. One of these bulb shaped "ergonomic" handles is illustrated in Ballole's U.S. Pat. No. 4,448,460. Nonetheless, while such a bulb shaped handle alleviates a number of the problems that use of sharp edged tools can create in the palm of the hand, a bulb shaped handle nonetheless can create a different set of nerve and blood vessel pressure problems. It creates these problems by requiring the wrist to bend back as the palm of the hand presses on the bulb. This bending back of the wrist can place extreme pressure on the median nerve and impair hand performance.

U.S. Pat. No. 4,631,853 to Brackett et al. discloses a contoured fishing rod handle with an outwardly curved, laterally offset projection on one side of the butt grip, and an outwardly curved, laterally offset complimentary projection on the same side of the reel seat segment as the butt grip. The fishing rod handle of Brackett et al. is designed to resist twisting, and not intended as a tool to exert longitudinal pressure.

German Patent No. 23 44 987 to Weber discloses a hand tool with a bulbous grip and indentations for the fingers.

U.S. Pat. No. 4,038,719 to Bennett discloses a tool handle comprising an elongated member with a grip at one end, wherein the grip is 15 to 25 degrees displaced from tool shaft.

What is needed in the art is a tool handle which avoids stressing the nerves, blood vessels and tendons of the hand by keeping the hand in a neutral position and distributing longitudinal tool forces evenly throughout the hand and arm of the user.

SUMMARY OF THE INVENTION

The present invention provides an ergonomic tool handle which is useful for a terminal insertion hand tool, gardening hand tools, knives, box cutters, screwdrivers and other pushing or pulling type hand tools. The tool handle of the present invention is contoured to the shape of the closed hand to distribute longitudinal tool forces evenly throughout the hand and arm of the user. The tool handle accomplishes this contoured fit by featuring a humplike crown which fits snugly into the pocket of the palm, a relatively flat underside around which the user's finger tips are wrapped and two sides with convex regions in diagonally offset relation. The shape of the tool when used follows the natural line of the hand and wrist which eliminates awkward, stressful postures. By adjusting one's hand up or down the tool handle, one size of tool handle can ergonomically fit approximately 95% of male and female hand sizes.

DESCRIPTION OF THE SPECIFIC EMBODIMENTS

Figure 1:
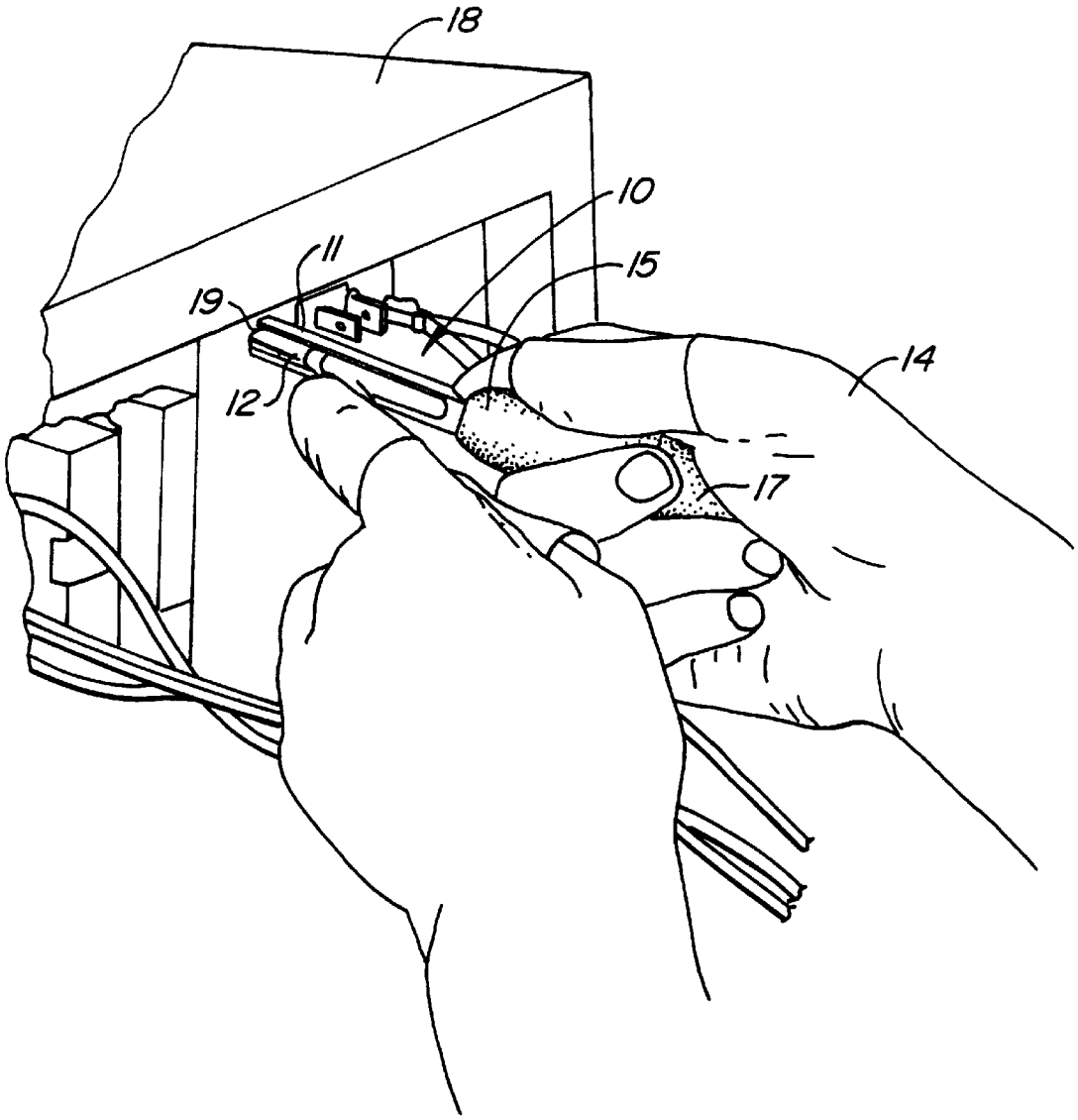
FIG. 1. PRIOR ART
FIG. 1 shows a terminal insertion tool of the prior art.

Referring now to FIG. 1, a single end terminal hand tool 10 from the prior art is shown placing spade 12 into terminal 19 of appliance 18. The prior art terminal hand tool 10 consists of handle 15 and terminal holder 11. The handle 15 of terminal hand tool is in a roughly cylindrical shape. In use, the palm of hand 14 typically applies a force of about 12 to 20 pounds to the end 17 of the handle 15 to insert the spade 12 into terminal 19. When this motion is repeated hundreds of times a day during a manufacturing operation, the nerves, blood vessels and tendons that run through the palm of hand 14 are likely to become damaged. Also, since the terminal hand tool 10 of the prior art has only one size of terminal holder 11, it can be used with only a limited range of terminals 19. For larger and smaller size terminals, a different size of terminal hand tool will typically be needed.

Figure 2A:
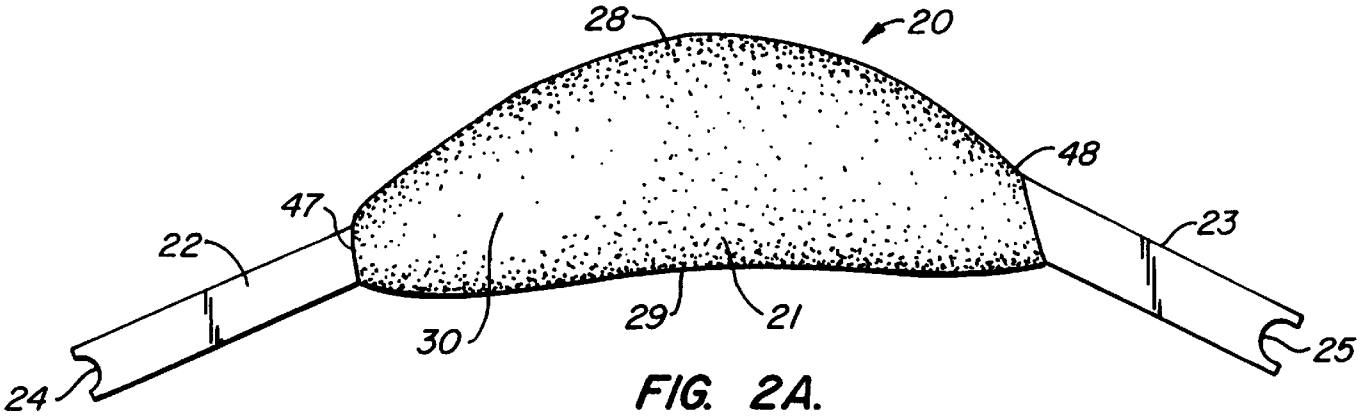
FIG. 2A shows a side view of the tool handle of the present invention as used in a dual end terminal insertion hand tool.
Figure 2B:
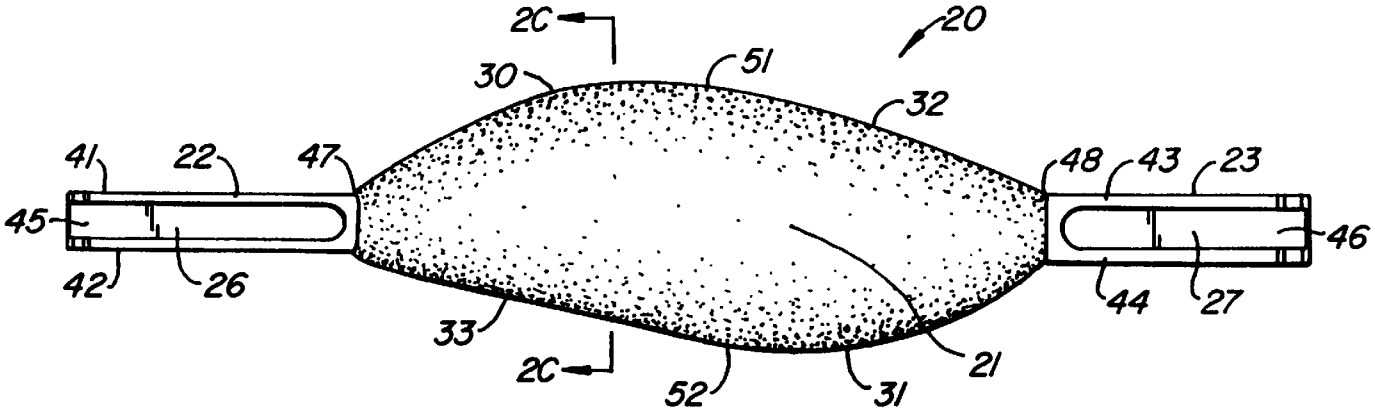
FIG. 2B shows a bottom view of the dual end terminal insertion hand tool of FIG. 2A.
Figure 2C:
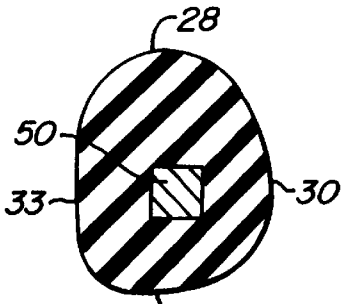
FIG. 2C shows a cross-sectional view of the dual end terminal hand tool of FIG. 2A.

FIGS. 2A–C show a terminal hand tool 20 using the tool handle 21 of the present invention. Unlike the prior art terminal hand tool shown in FIG. 1, this terminal hand tool has two terminal holders 22 and 23. Each terminal holder 22, 23 has two side walls 41, 42, 43, 44 and one top wall 45, 46. One of these terminal holders 22 is made to fit smaller sizes of terminals and the other terminal holder 23 is made to fit larger sizes of terminals so that together the two terminal holders will fit approximately 90% of all terminals now in use. The internal width between each side wall 41, 42 of the slot 26 for the smaller terminal holder 22 is, in the preferred embodiment, 0.476 cm. By comparison, the internal width between each side wall 43, 44 of the slot 27 for the larger terminal holder 23 is, in the preferred embodiment, 0.635 cm. Both terminal holders 22, 23 are preferably constructed of a hard, durable material such as 9.5 and 7.9 mm thick stainless steel bar stock which is fabricated in the manner shown in FIGS. 2A–B.

At the far end of each terminal holder 22, 23 is a crescent shaped slot 24, 25 or "end effector" in each side wall. This crescent shaped slot is used to grasp the end of the spade 12 so that it can be forced into the terminal 19. This crescent shaped slot preferably has a diameter which is comparable to the slot width between side walls (i.e., 0.476 cm diameter for the smaller terminal holder 22 and 0.635 cm diameter for the larger terminal holder 23).

Each terminal holder 22, 23 is firmly and unmovably affixed to a respective tapered end 47, 48 of tool handle 21. Preferably, the terminal holders are formed as part of or fused onto a central shaft 50 which runs through the interior of tool handle 21. As shown in FIG. 2A, each terminal holder is preferably angled approximately 15 degrees down from a centerline created by the respective tapered ends 47, 48 of tool handle 21. This angling down of the terminal holders simultaneously accomplishes three objectives: (1) it allows the tool pushing forces to be more evenly distributed throughout the hand and arm of the user and (2) it promotes a neutral posture between the hand and wrist which reduces median nerve compression and (3) it displaces the unused terminal holder end away from the hand of the user to prevent unwanted interference with the hand.

Tool handle 21 has a top 28, bottom 29 and two sides 51, 52. The top 28 of tool handle 21 is formed in the shape of a humplike crown to fit snugly into the pocket of the user's palm. By contrast, the bottom 29 of the tool handle 21 is formed in an essentially flat or slightly concave shape so that the tips of the user's fingers can comfortably rest against it. Both sides 51, 52 of the tool handle 21 have convex or humplike regions 30, 31 which are placed next to flat or slightly concave regions 32, 33. Both sets of convex or humplike regions 30, 31 and both sets of flat or slightly concave regions 32, 33 are constructed to be diagonally offset from one another. Put another way, each terminal holder 22, 23 shown in FIGS. 2A–B adjoins both a convex or slightly humplike region 30, 31 and a flat or slightly concave region 32, 33. On one side, the flat of slightly concave region 32 rests against the hypothenar of the palm while the thumb is allowed to curve around the convex or humplike region 30. On the other side, the flat or slightly concave region 33 rests against the base of the middle finger and the convex or humplike region 31 adjoins the base of the hand's small fingers.

Tool handle 21 is preferably formed of a durable material which is hard yet comfortable to the hand. Suitable materials for tool handle 21 include wood, plastic or rubber. A preferred form of tool handle has an approximate length between terminal holders of 10 cm, an approximate width between the crest of opposing humps 30, 31 of 4 cm and an approximate height between the bottom 29 and crest of humplike crown 28 of 3.5 cm. With these dimensions, the tool handle 21 of the present invention has been found to comfortably fit about 95% of all male and female hand sizes. To enhance the comfort of the fit, it has been found that users with larger hands tend to grip farther back on the handle 21 while users with smaller hands tend to grip farther forward on the handle 21.

Figure 3A:
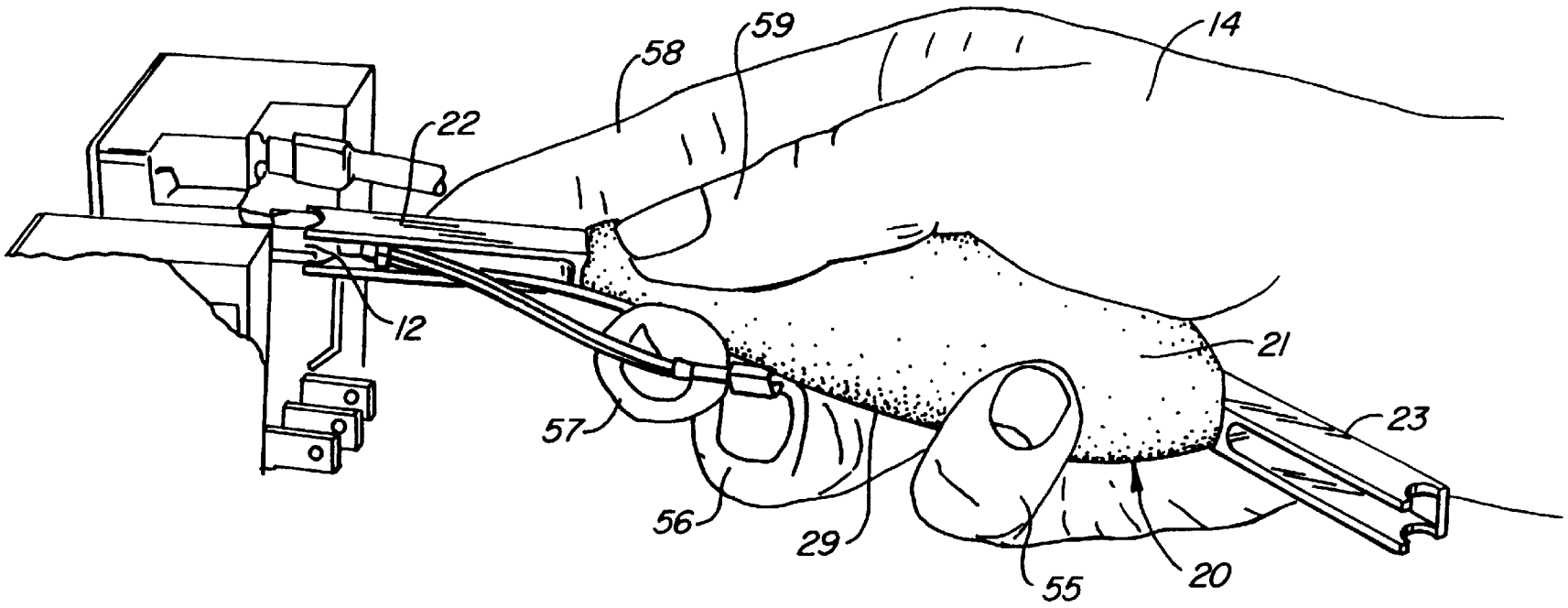
FIG. 3A shows a bottom view of the dual end terminal hand tool of FIGS. 2A–C in the hand of a user to connect a spade into a terminal.
Figure 3B:
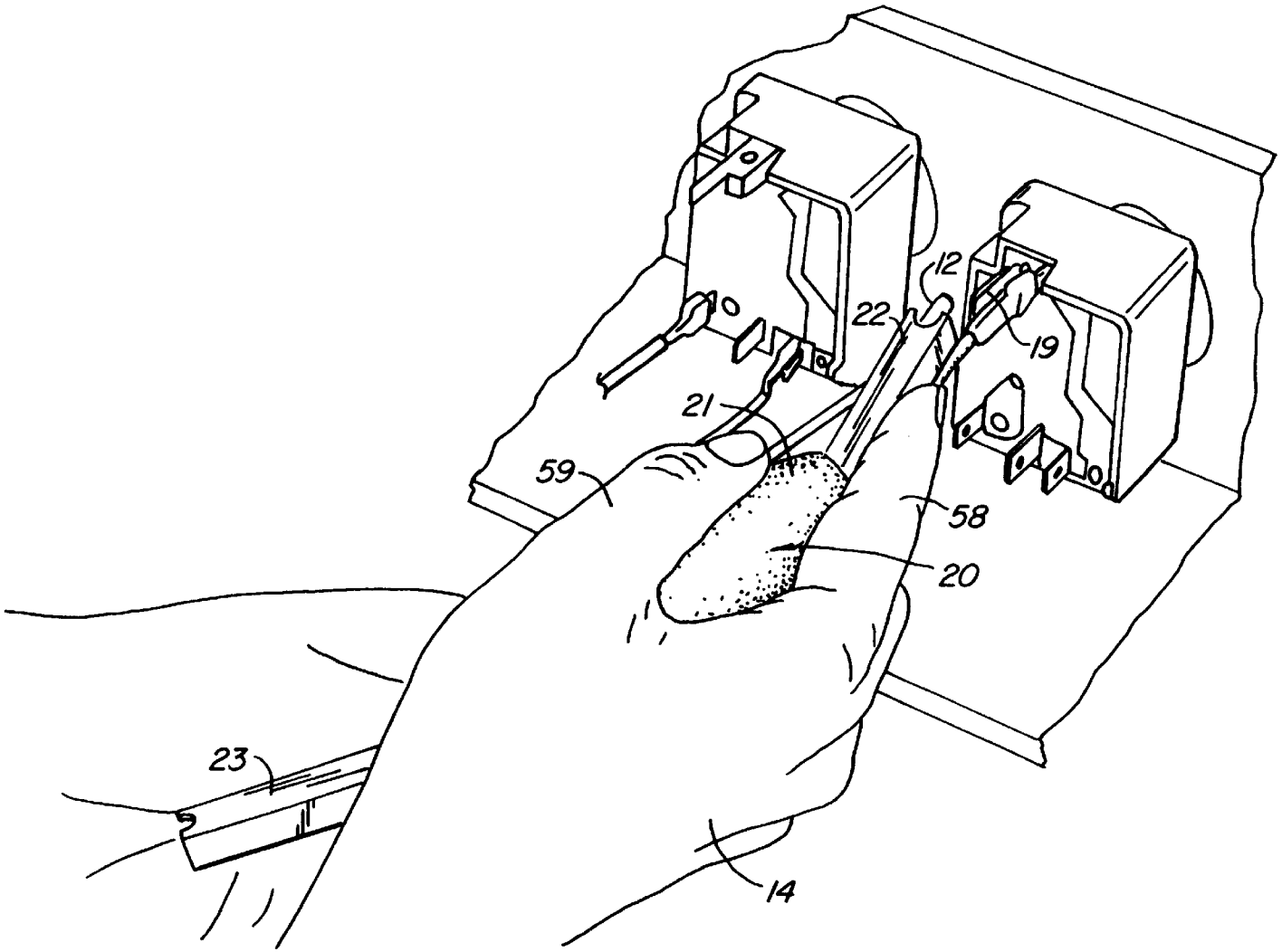
FIG. 3B shows a side view of the dual end terminal hand tool of FIGS. 2A–C in the hand of a user to connect a spade into a terminal.

FIGS. 3A–B illustrate the dual end terminal hand tool 20 of the present invention within the hand 14 of a user for connecting a spade 12 into a terminal 19. As can be seen in these figures, the top of the handle fits snugly into the pocket of the palm between the base of the thumb muscle (thenar) and the base of the small finger muscle (hypothenar) and the bottom 29 of the handle is gripped by the tips 55, 56, 57 of the user's fingers. The user's thumb 59 is slightly curled around a convex or slightly humplike region on the side of the tool handle 21 while the user's forefinger 58 will typically project longitudinally along the top of the handle and along a portion of the terminal holder 22. This longitudinal projection of the forefinger along a portion of the terminal holder allows the forefinger to guide the spade 12 into the terminal 19 by pointing in the direction of the connection.

One advantage of the preferred dual end terminal hand tool 20 of the present invention is that the user can easily switch back and forth between having the small terminal holder 22 and large terminal holder 23 pointing forward without losing the benefits of the tool handle 21 in either direction. In other words, the dual end terminal hand tool 20 will fit in the user's hand in essentially the same way regardless of which terminal holder 22, 23 is pointing forward.

As will be readily recognized by those of skill in the art, the tool handle 21 of the present invention can be used in a wide variety of other pushing tool applications besides the dual end terminal hand tool 20 previously described. For example, one terminal holder 23 could easily be removed from the dual end terminal hand tool embodiment previously described to create a terminal hand tool with only one terminal holder. Alternatively, other types of push or pull type hand tools could be formed at one or both ends of the tool handle 21 to create a different type of tool. For (example, a trowel blade could be connected to one end of the tool handle 21 and a gardening fork connected to the other end to create a handy dual end gardening tool. As another example, a retractable knife could be connected to one end of the tool handle 21 and a retractable box cutter blade connected to the other end to create a handy multipurpose cutting tool. As a third example, a battery powered flat head screwdriver could be connected to one end of the tool handle 21 and a battery powered phillips head screwdriver connected to the other end to create a handy dual end shop tool. As such, the number of potential adaptations for the tool handle of the present invention are as limitless as the number of existing push and pull hand tools.

In the foregoing specification, the invention has been described with reference to specific preferred embodiments and methods. It will, however, be evident to those of skill in the art that various modifications and changes may be made without departing from the broader spirit and scope of the invention. The specification and drawings are, accordingly, to be regarded in an illustrative, rather than restrictive sense.

What is claimed is:

1. An ergonomic handle (21) for a hand tool (20) comprising:

an arched body having a top (28), a bottom (29), two opposing sides (51, 52) and two opposing ends (47, 48);

said top (28) shaped in the form of a humplike crown which fits snugly into the pocket of the palm to distribute longitudinal forces evenly throughout the hand and arm of the user;

said bottom (29) being slightly concave in shape;

each of said sides having adjacent humplike (30, 31) and slightly concave (32, 33) regions oriented so that said humplike region (30 or 31) on one of said sides (51 or 52) directly opposes said slightly concave region (32 or 33) on the other side (51 or 52).

2. The ergonomic handle (21) of claim 1 wherein said handle (21) is formed of a durable material.

3. A tool (20) with an ergonomic handle (21) comprising:

an arched handle having a top (28), a bottom (29), two opposing sides (51, 52) and two opposing ends (47, 48);

said handle top (28) shaped in the form of a humplike crown which fits snugly into the pocket of the palm to distribute longitudinal forces evenly throughout the hand and arm of the user;

said handle bottom (29) being slightly concave in shape;

each of said handle sides (51, 52) having adjacent humplike; (30, 31) and slightly concave (32, 33) regions oriented so that said humplike region (30 or 31) on one of said sides (51 or 52) directly opposes said slightly concave region (32 or 33) on the other side (51 or 52);

one of said handle ends (47 or 48) being attached to said tool (20).

4. The tool (20) with an ergonomic handle (21) of claim 3 wherein said tool (20) is a terminal holder.

5. The tool (20) with an ergonomic handle 21 of claim 3 wherein a terminal holder tool (22, 23) is attached to each of said two handle ends (47, 48), said terminal holder tools (22, 23) being of different sizes.

6. The tool (20) with an ergonomic handle (21) of claim 3 wherein a Phillips head screwdriver is attached to one of said handle ends (47 or 48) and a flat head screwdriver is attached to the other handle end (47 or 48).

7. An ergonomic handle (21) for a hand tool (20) comprising:

an arched body having a top (28), a bottom (29), two opposing sides (51, 52) and two opposing ends (47, 48);

said top (28) shaped in the form of a humplike crown which fits snugly into the pocket of the palm to distribute longitudinal forces evenly throughout the hand and arm of the user;

said bottom (29) being slightly concave in shape;

each of said sides (51, 52) having adjacent humplike (30, 31) and approximately flat (32, 33) regions oriented so that said humplike region (30 or 31) on one of said sides (51 or 52) directly opposes said approximately flat region (32 or 33) on the other side (51 or 52).

* * * * *